United States Patent [19]

Patel et al.

[11] 4,418,134

[45] Nov. 29, 1983

[54] AQUEOUS COMPOSITION-SENSITIVE PHOTOCONDUCTIVE COMPOSITION

[75] Inventors: Jayanti Patel, Fairlawn, N.J.; Ken-ichi Shimazu, Briarcliff Manor, N.Y.

[73] Assignee: Polychrome Corporation, Yonkers, N.Y.

[21] Appl. No.: 479,612

[22] Filed: Mar. 28, 1983

Related U.S. Application Data

[63] Continuation of Ser. No. 289,027, Aug. 3, 1981, abandoned.

[51] Int. Cl.[3] ..... G03G 5/087; G03G 5/06; G03G 5/09

[52] U.S. Cl. ..... 430/88; 430/49; 430/56; 430/95; 430/96

[58] Field of Search ..... 430/49, 56, 81, 83, 430/88, 95, 96

[56] References Cited

U.S. PATENT DOCUMENTS

| | | | |
|---|---|---|---|
| 3,232,755 | 2/1966 | Hoegl et al. | 430/81 X |
| 3,287,120 | 11/1966 | Hoegl | 430/83 X |
| 3,899,329 | 8/1975 | Bean et al. | 430/96 X |
| 4,076,528 | 2/1978 | Bean et al. | 430/96 X |

FOREIGN PATENT DOCUMENTS

| | | | |
|---|---|---|---|
| 2054118 | 5/1972 | Fed. Rep. of Germany | 430/56 |

*Primary Examiner*—Roland E. Martin, Jr.

[57] ABSTRACT

An aqueous composition-sensitive photoconductive composition useful in the preparation of aqueous composition decoatable electrophotographic elements, such elements and low cost lithographic printing plates prepared from said elements the aqueous composition-sensitive photoconductive composition comprising the admixture of an inorganic photoconductor, an organic photoconductor and an aqueous composition-sensitive resin, and, if desired, to increase exposure speed, a dyestuff photosensitizer.

11 Claims, No Drawings

AQUEOUS COMPOSITION-SENSITIVE PHOTOCONDUCTIVE COMPOSITION

CROSS REFERENCE TO RELATED APPLICATIONS

The present application is a continuation of application Ser. No. 289,027 filed Aug. 3, 1981.

BACKGROUND OF THE INVENTION

This invention relates to lithographic printing plates. More particularly, it relates to an aqueous composition-sensitive, photoconductive insulating composition useful in the preparation of electrophotographic elements, to such elements, to a process for preparing lithographic printing plates from such electrophotographic elements and to the lithographic printing plates prepared by such a process.

Electrophotographic reproduction is based on the ability of some normally insulating materials, whose surfaces have been electrically charged, to selectively conduct electric charge upon imagewise irradiation whereby an electrostatic latent image is formed upon such a material. I.e., the charge is conducted away from the surface and through those portions of the insulating materials which have been exposed to the radiation while the areas of the surface which have not been irradiated retain their original charges. The electrostatic latent image is an invisible electrostatic charge pattern generated in a usual exposure procedure, e.g., by lens-projected imaging or contact-printing methods, wherein the charge density at the various areas of the surface is a function of the intensity of irradiation at said areas during exposure. The thus formed latent image may be developed (i.e., made visible) by treatment with a powder (which may or may not be colored and/or mixed with a binding resin) which is attracted to the non-irradiated surface areas which have retained their charges thereby providing a sharp contrast between the irradiated (non-image) and non-irradiated (image) areas. The developing agent is chosen so that after fixation it is resistant to the subsequently applied aqueous composition and prevents attack by said solution on the underlying photoconductive layer. The visible image is then fixed by causing it to become permanently attached to a support on which the image is desired. The support may be the original support to which the composition was applied before exposure or a material to which the image was transferred after development and is chosen in accordance with the desired end use. For instance, if the final product is to be a lithographic printing plate then the supporting material is a lithographically suitable supporting material to which the photoconductive composition is applied and the developed image is fixed directly thereupon. In that case the exposed areas are removed (decoated) from the plate after the image has been fixed thereon, by means of decoating compositions, i.e., aqueous compositions which attack and either dissolve or disperse the exposed photoconductive composition so that it no longer adheres to the support material.

The electrostatic latent image is formed on the surface of an insulating photoconductive layer carried on a conductive support. For example, the free surface of the photoconductive layer is uniformly charged, in the dark, e.g., by application of a corona discharge, and most of the charge is maintained on said surface, due to the insulating character of the layer, in the absence of irradiation. Upon imagewise exposure, however, the conductivity of the layer is greatly increased in the irradiated areas in proportion to the intensity of irradiation. Thus, the surface charge in such areas is permitted to "leak" off while the charge in the irradiated areas is not affected. This pattern of charged and uncharged surface areas is the aforementioned electrostatic latent image.

Electrophotographic materials and processes are of great importance in many areas of the graphic arts industry including the preparation of lithographic printing plates, where they have been found to be preferable to other conventional methods which require additional process steps of preparing a mask or transparency from the original image prior to the exposure step. This requirement has, inter alia, the disadvantage of using a film for the transparency which is expensive (especially if the film uses a silver halide coating) and requiring additional equipment for preparing the transparencies. In the electrographic processes the above step is not required as the image is formed on the printing plate directly from the original resulting in considerable savings in money and time. This increased interest has created a need for suitable materials meeting stringent requirements regarding, e.g., spectral range of use (i.e., range of radiation wavelengths within which material is photoconductive), simplicity of handling, and reliability. In the past such materials have included elemental and inorganic substances such as, selenium, sulfur, zinc oxide, and tellurium and organic substances such as, anthracene and anthraquinone.

The above materials, however, suffer from a number of disadvantages, e.g., in the areas of spectral range of use, ease of handling, light sensitivity and stability.

The above disadvantages have been somewhat obviated by compositions comprising the substituted oxadiazoles described in U.S. Pat. No. 3,189,447 or the substituted oxazoles described in U.S. Pat. No. 3,257,203 which may also comprise *water insoluble* resins, as well as photosensitizers to increase their sensitivity to the visible areas of the spectrum.

However, said compositions suffer the disadvantages of poor resolution and sensitivity to the "pre-exposure effect" and high material costs.

"Sensitivity to the pre-exposure effect" refers to that property of some insulating photoconductive materials whereby their capacity to be charged, as well as their photoconductivity upon irradiation is temporarily decreased upon exposure to radiation, prior to the electrostatic charging. These decreased capacities return to their normal values after the elements have been stored in the dark for a period of time. The need for such "dark storage" is disadvantageous either with respect to an increase in "down-time" or by requiring an excess of inventory.

Additionally, the elements comprising the above photoconductive compositions *can only be decoated using organic solvents.* At present, when the environmental impact of all industrial processes and materials is being critically scrutinized, that factor can be an extreme limitation on the use of such compositions and provides an incentive for greater research efforts to produce elements which can be decoated by means of *aqueous* compositions.

The instant invention overcomes the aforementioned disadvantages by providing a low cost composition which has good spectral sensitivity, good speed, good resolution, is not subject to the pre-exposure effect, and is *decoatable,* by aqueous compositions.

SUMMARY OF THE INVENTION

It is an object of this invention to provide a photoconductive insulating composition of good spectral sensitivity, good speed and good resolution which is soluble or dispersible in *aqueous* compositions.

It is a further object of the invention to provide an electrophotographic element of good spectral sensitivity, good speed, good resolution and which after imagewise exposure and fixing may be decoated by means of *aqueous* compositions.

According to yet another object of the instant invention there is also provided a low cost lithographic printing plate of good resolution. These and other objects of the invention will be in part discussed and in part apparent upon a consideration of the detailed description of the preferred embodiment.

DETAILED DESCRIPTION OF THE PREFERRED EMBODIMENT

In accordance with the invention it has now been found that a photoconductive composition of good spectral sensitivity, good speed, good resolution and solubility of dispersibility in *aqueous* compositions may be prepared by admixing an inorganic photoconductor, a photoconductive organic pigment and at least one insulating resin which is soluble or dispersible in aqueous compositions.

Thus, in accordance with this invention there is provided an aqueous composition-sensitive photoconductive composition comprising an admixture of, I. at least one inorganic photoconductor, II. at least one photoconductive organic pigment, and III. at least one aqueous composition-sensitive insulating resin.

Inorganic photoconductors useful in connection with the invention are any of those known in the art including zinc oxide, titanium dioxide, and the like. A preferred inorganic photoconductor is zinc oxide.

The organic photoconductive pigments which may be used according to the invention are known in the art and include anthraquinone class pigments, preferably C.I. Pigment Red 168 (e.g., Monolite TM Red 2Y, I.C.I. Co.) and C.I. Pigment Orange 43 (e.g., Indofast TM, Hermon Chemical Co., Hostaperm TM Orange GR, Hoechst Co.) wherein C.I. indicates "Color Index".

The aqueous composition-sensitive (defined as being either soluble or dispersible in the aqueous composition) resins useful in accordance with the invention are known in the art and include phenol-formaldehyde resins, phenoxy resins, epoxy resins and homo- and co-polymers comprising residues of "vinyl alcohol" (which exists only in polymers), hydroxyalkyl acrylates or methacrylates, vinyl acetate, acrylic monomers, N-vinylpyrrolidone-2,vinylsulfonic acid, styrenesulfonic acid, acrylamide and its derivatives, maleic anhydride, vinyl ethers, and the like. Preferred resins are phenoxy resins (e.g., Bakelite® phenoxy resin PKHH, Union Carbide Corp.) and poly(vinyl acetate) homo- or copolymers.

The decoating aqueous compositions may be any of those known to the art for decoating aqueous composition-sensitive resins, preferably aqueous alkaline solutions of pH of greater than 10.

Use of the above compositions is however, limited due to their relatively slow speed. It has now been found, in accordance with another embodiment of the instant invention, that the speed of the above compositions may be increased by addition of dyestuff photosensitizers. Photosensitizers which may be used in this invention include triarylmethane dyes, such as, Methyl Violet; xanthene dyes such as the rhodamines (e.g., Rhodamine B) and phthaleins (e.g., Rose Bengal); and the like and mixtures thereof. A preferred photosensitizer is Rose Bengal.

In a preferred embodiment the photoconductive composition comprises about 3 to about 25% wt. of the inorganic photoconductor, amounts of organic photoconductive pigment in the range of about 4 to about 30% wt. and about 20 to about 80% wt. of the aqueous composition-sensitive resin, all of the percentages being based on the weight of the dried coating.

In a most preferred embodiment the composition further comprises about 0.5 to about 5% wt. of dyestuff photosensitizers based on the total weight of the dried coating.

In addition, if desired, the photoconductive composition may comprise other additives selected from "other" resins, i.e., resins which are not aqueous composition-sensitive, reactive diluents which are converted to aqueous composition-sensitive resins or "other" resins upon irradiation, plasticizers, fillers, colorants, thermally and/or photolytically activated polymerization initiators, thermal polymerization inhibitors, and the like and mixtures thereof.

Other resins useful in connection with the invention may be illustrated by polystyrene, ABS terpolymers, ethylene-propylene rubbers, and the like.

The reactive diluents may be any of those known in the art, such as, vinyl acetate, styrene, alkyl acrylates and methacrylates, maleic anhydride, and the like.

According to the invention there is also provided an electrophotographic element comprising an electrically conductive support having adherent to at least one surface thereof any of the photoconductive compositions of the invention as described above.

The electrically conductive support may comprise any of those supports known in the art including metal sheets or foils, glass plates, paper sheets or webs or plastic sheets or webs especially those made of electrically conductive resins. The supports, dependent upon the intended end use of the elements, may be opaque, translucent or transparent. If an absorbent support, such as paper, is ued it is desirable that it be pretreated to prevent absorption of the coating solution. The pretreatment may be accomplished by, e.g., adsorption of methyl cellulose or poly (vinyl alcohol) from aqueous solutions or polyamides from aqueous alcoholic solutions.

The photoconductive compositions may be applied to the support by any means known to the art, such as, spray, meniscus, wire wound rod reverse coating, gravure coating, whirl coating from solutions in appropriate solvents or by melt coating of the undissolved photoconductive compositions.

The present invention also provides a method for preparing lithographic printing plates which comprises the steps of, I. electrostatically charging the free surface of the photoconductive layers of any of the above elements, prepared according to the invention, wherein the conductive support comprises a lithographically suitable material;

II. image-wise exposing the charged surface to radiation, whereby the charge is discharged in the exposed areas in proportion to the intensity of the radiation, to provide an electrostatic latent image;

III. developing said latent image to provide a visible image;

IV. fixing said visible image, and

V. removing the exposed photoconductive composition by treatment with a suitable aqueous composition to produce the desired printing plate.

If desired, stages I to IV may be repeated several times, before going to to step V, using different masks in order to superimpose several images upon each other in the final plate.

While the coatings are, in themselves, non-radiation-sensitive application of a positive or negative electrostatic charge thereto, e.g., by means of a corona discharge, renders them radiation-sensitive.

The electrostatic latent image is formed on the charged element by imagewise irradiation thereof. The radiation may be selected from the whole electromagnetic spectrum including, visible light, UV or IR radiation and electron beam. Preferred radiation is in the UV and visible light areas of the spectrum.

Development of the latent electrostatic image may be accomplished by any means known in the art including treatment of the imagewise exposed eoement with liquid or dry toners such as, dye filled resins and the carbon black or colored resin described in U.S. Pat. No. 3,189,447.

The developed (visible) image is then made permanent, (i.e., fixed) e.g., by heating in the presence or absence of solvent vapors, or by treatment with steam and/or pressure.

The thus fixed image element is then converted to the desired lithographic printing plate by treatment with an appropriate, aqueous composition, preferably an aqueous alkali solution preferably of a pH of greater of 10, to remove the exposed aqueous composition soluble or dispersible photoconductive composition. If desired, the aqueous composition may also comprise organic solvents to aid in wetting the resinous components of the photoconductive composition whereby removal of the exposed composition from the support is facilitated.

The following examples are illustrative of the invention and methods for its accomplishment.

EXAMPLE 1

A mixture comprising 10.0 gms of Monolite TM Red 2Y, 8.0 gms of ZnO, 0.1 gms of Rose Bengal, 50 ml. of methyl Cellosolve TM (MC) and 100 ml methyl ethyl ketone (MEK) was ground in a ball mill (using Borundum TM balls) for 16 hours. To the above mixture was then added a solution comprising 40.0 gms of Resyn ® 28-2930 (a carboxylated vinyl acetate terpolymer manufactured by National Starch and Chemical Corp., Bridgewater, N.J.) 50 ml of MC and 100 ml MEK. The resultant mixture was then milled an additional 3 hours.

The above mixture was applied by means of #18 wire wound rod to a 14½ in. by 22 inch, 12 gauge sheet of aluminum which had first been pumice grained and anodized. The resultant element was then dried using a hot air blower followed by heating at 100° C. for ½ hour to yield the desired electrophotographic element.

The free insulating surface of the above element was then electrostatically charged by means of a corona discharge, imagewise exposed to a Visible/Argon Laser (Muirhead, Inc.) at 80 amps Laser power, toned and fixed by heating. The resultant plate was then decoated, to remove exposed (non-image) portions of the coating, by means of an aqueous alkaline decoating solution. The decoated plate was then gummed by conventional means and used on an ATF Chief TM press to produce 121,000 acceptable impressions.

EXAMPLE 2

Example 1 was repeated except that 5.0 gms of Resyn TM 28-2930 were replaced by 5.0 gms of Bakelite TM phenoxy resin PKHH, the Monolite Red was replaced by 10.0 gms of Hostaperm TM Orange GR and only 4.0 gms of ZnO were used. Similar results were obtained.

What is claimed is:

1. A photoconductive composition, which is dispersible in aqueous compositions, consisting essentially of an admixture of I. at least one inorganic photoconductor selected from the group consisting of ZnO and $TiO_2$, II. at least one photoconductive anthraquinone pigment, and III. at least one insulating resin soluble or dispersible in an aqueous composition.

2. The photoconductive composition according to claim 1 further containing at least one dyestuff sensitizer.

3. The photoconductive composition according to claim 1 wherein said dyestuff sensitizer is selected from the group consisting of triarylmethane and xanthene dyes.

4. The photoconductive composition according to claim 3 wherein said dyestuff sensitizer is Rose Bengal.

5. The photoconductive composition according to claim 1 further containing at least one additive selected from the group consisting of colorants, other resins, reactive diluents, plasticizers, fillers, thermally and/or photolytically activated polymerization initiators, and thermal polymerization inhibitors.

6. The photoconductive composition according to claim 1 wherein said photoconductor is ZnO.

7. The photoconductive composition according to claim 1 wherein said pigment is selected from the group consisting of C.I. Pigment Red 168, and C.I. Pigment Orange 43.

8. The photoconductive composition according to claim 1 wherein said resin is selected from the group consisting of phenolformaldehyde resins, phenoxy resins, epoxy resins and homo and co-polymers of vinyl acetate, and acrylic monomers.

9. The photoconductive composition according to claim 1 wherein said inorganic photoconductor is ZnO, the organic photoconductor is C.I. Pigment Orange 43, the resin is a carboxyl containing poly(vinyl acetate) copolymer and the sensitizer is Rose Bengal.

10. An electrophotographic element comprising a conductive base material having coated upon at least one surface thereof an photoconductive composition, which is soluble or dispersible in aqueous compositions, consisting essentially of as major ingredients:

I. at least one inorganic photoconductor selected from the group consisting of Zn0 and $TiO_2$, II. at least one photoconductive anthraquinone pigment, and III. at least one insulating resin soluble or dispersible in an aqueous composition.

11. The element according to claim 10 wherein said composition further contains at least one dyestuff sensitizer.

* * * * *